US005874854A

United States Patent [19]

Skergan

[11] Patent Number: 5,874,854

[45] Date of Patent: Feb. 23, 1999

[54] CONTROL SCHEME FOR ON-CHIP CAPACITOR DEGATING

[75] Inventor: Timothy Michael Skergan, Austin, Tex.

[73] Assignee: International Business Machines Corporation, Armonk, N.Y.

[21] Appl. No.: 829,483

[22] Filed: Mar. 28, 1997

[51] Int. Cl.[6] ..... G05F 1/10

[52] U.S. Cl. ..... 327/545; 327/337; 307/48; 307/66; 320/166

[58] Field of Search ..... 327/334, 337, 327/545, 530, 525; 307/48, 66; 320/166, 167

[56] References Cited

U.S. PATENT DOCUMENTS

| | | | |
|---|---|---|---|
| 4,272,831 | 6/1981 | Ullrich | 327/545 |
| 4,281,401 | 7/1981 | Redwine et al. | 327/545 |
| 4,484,276 | 11/1984 | Porter et al. | 364/200 |
| 4,636,658 | 1/1987 | Arakawa | 327/545 |
| 4,809,162 | 2/1989 | Si | 364/200 |
| 4,900,951 | 2/1990 | Saito et al. | 327/545 |
| 5,109,169 | 4/1992 | Hughes | 327/337 |
| 5,391,999 | 2/1995 | Early et al. | 327/337 |
| 5,466,676 | 11/1995 | Booth et al. | 514/44 |

*Primary Examiner*—Timothy P. Callahan
*Assistant Examiner*—Jung Ho Kim
*Attorney, Agent, or Firm*—Richard A. Henkler; Jack V. Musgrove; Andrew J. Dillon

[57] ABSTRACT

A method of controlling a plurality of on-chip capacitors used to enhance power supply to logic circuits for a computer processor. The capacitors are each provided with transistors which temporarily disable the capacitors when an appropriate logic state is applied to the gate of the transistors. In this manner the effects of the capacitors upon system performance can be measured, and if a particular capacitor (or capacitor bank) is defective or presents an adverse impact, it can be permanently disabled by blowing fuses provided for each capacitor (or capacitor bank). The capacitors may be selectively disabled using a control circuit which has a multiplexer provided with a set of inputs from a register which contains a bit pattern that is used to determine which capacitors to disable. The register can be loaded with any pattern or with a pattern that corresponds to the states of the unblown fuses. Alternatively, all of the capacitors may be disabled, such as during power-on reset.

15 Claims, 3 Drawing Sheets

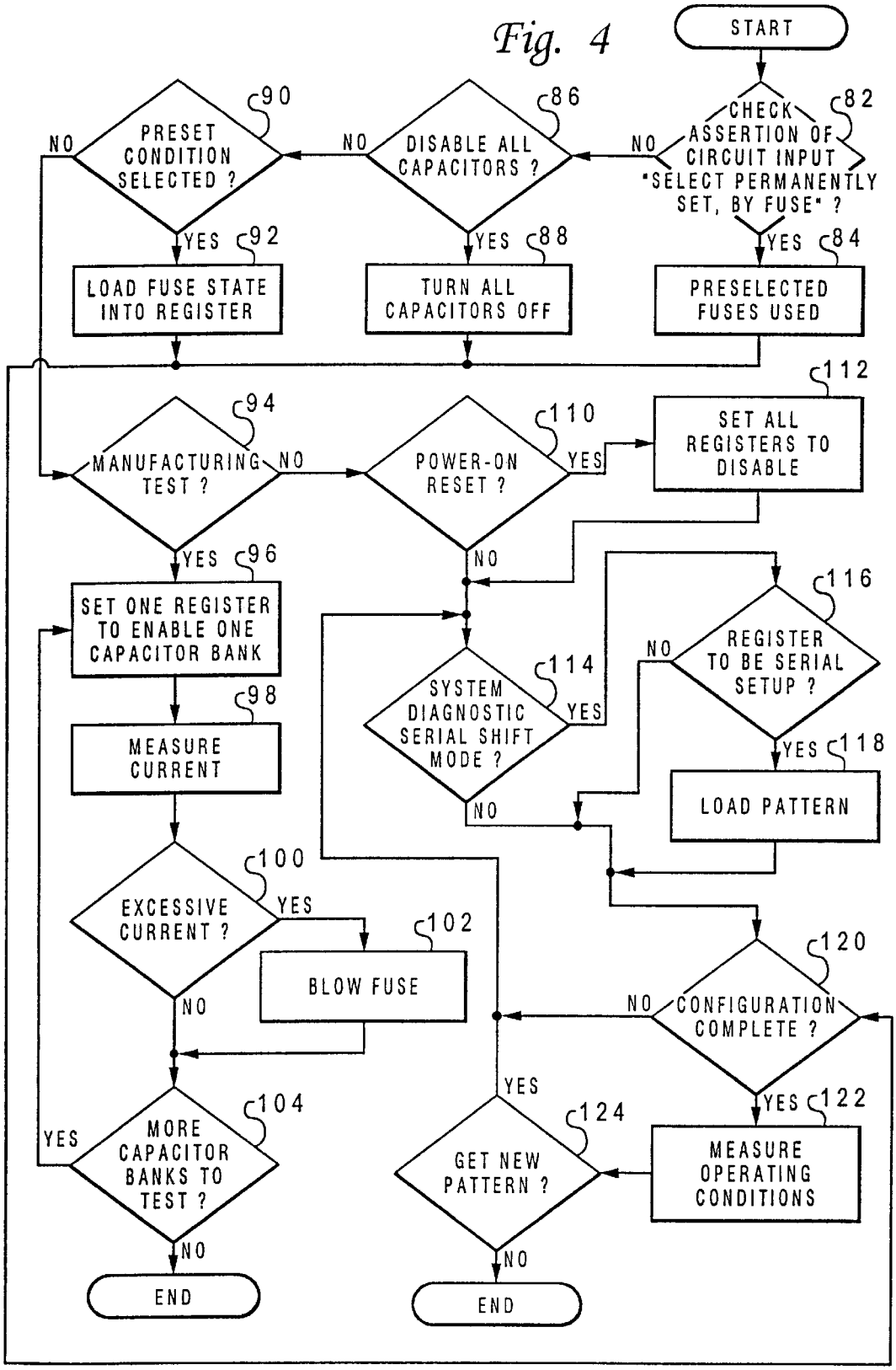
Fig. 4
START
CHECK ASSERTION OF CIRCUIT INPUT "SELECT PERMANENTLY SET, BY FUSE" ?
82
NO
YES
84
PRESELECTED FUSES USED
DISABLE ALL CAPACITORS ?
86
NO
YES
88
TURN ALL CAPACITORS OFF
PRESET CONDITION SELECTED ?
90
NO
YES
92
LOAD FUSE STATE INTO REGISTER
MANUFACTURING TEST ?
94
NO
YES
96
SET ONE REGISTER TO ENABLE ONE CAPACITOR BANK
98
MEASURE CURRENT
EXCESSIVE CURRENT ?
100
YES
NO
102
BLOW FUSE
MORE CAPACITOR BANKS TO TEST ?
104
YES
NO
END
POWER-ON RESET ?
110
YES
NO
112
SET ALL REGISTERS TO DISABLE
SYSTEM DIAGNOSTIC SERIAL SHIFT MODE ?
114
YES
NO
REGISTER TO BE SERIAL SETUP ?
116
NO
YES
118
LOAD PATTERN
CONFIGURATION COMPLETE ?
120
NO
YES
122
MEASURE OPERATING CONDITIONS
GET NEW PATTERN ?
124
YES
NO
END

CONTROL SCHEME FOR ON-CHIP CAPACITOR DEGATING

BACKGROUND OF THE INVENTION

1. Field of the Invention

The present invention generally relates to computer systems and, more particularly, to a method of controlling capacitors which are provided on a computer chip to enhance power supply, allowing testing of the computer system to determine the effects of the on-chip capacitors and allowing selective disabling of the capacitors as necessary.

2. Description of the Related Art

The basic structure of a conventional computer system includes a central processing unit (CPU) or processor which is connected to several peripheral devices, including input/output (I/O) devices (such as a display monitor and keyboard) for the user interface, a permanent memory device (such as a hard disk or floppy diskette) for storing the computer's operating system and user programs, and a temporary memory device (such as random-access memory or RAM) that is used by the processor to store instructions and data during program execution. The processor itself includes many different circuits, and these circuits are often fabricated on separate chips (silicon substrates), and then interconnected by various means. Recently, chip-fabrication techniques have allowed these circuits to be formed from a single die as shown in FIG. 1. Several exemplary circuits are depicted in that figure, including a fixed-point circuit 2, a floating-point circuit 4, a storage-control circuit 6, an instruction-control circuit 8, and a data-control circuit 10, all formed on a single computer chip 12. These circuits contain the various registers and logic units which carry out program instructions. Fabrication of the circuits on a single chip has several advantages, including quicker processing speeds and a smaller chip size.

One problem that has emerged in consolidating so many different circuits on a single chip relates to the power supply for the circuits. With so many circuits on a single chip, there can be degradations in processor performance due to, e.g., lag times associated with switching of latches in the processor registers and logic units, i.e., from low-voltage states to high-voltage states. One approach that has been implemented to address this problem is the further inclusion of many capacitors (tens of thousands) arranged in banks and distributed across (i.e., formed on) the chip, such as the capacitor banks 14 shown in FIG. 1 which are respectively connected to the various circuits and to a power supply 16. Such an approach allows the capacitors to instantaneously supply power to the circuits in an improved manner, relieving some of the performance degradation problems.

The provision of on-chip capacitors raises further concerns, however, particularly capacitor reliability and performance issues. There are concerns regarding how the capacitors function during processor operation and what their impact might be on the chip's functionality. Presently, there is no way to analyze this impact under different operating conditions and applications, such as burn-in and system environment conditions and functional and self-test applications. There is also no way to disable the capacitors in cases of unreliability and adverse electrical impacts that may have been introduced by the provision of the capacitors. It would, therefore, be desirable to devise a method of testing the reliability of on-chip capacitors and of determining the impact of these capacitors on processor performance. It would be further advantageous if the method would allow selective testing of a particular bank or banks of the capacitors, and if the method were compatible with a means for disabling the capacitors in those situations where the capacitors were either unreliable or created an excessively adverse impact on processor performance. Such disabling of the capacitors would be particularly useful if the disabling could be achieved without having to initialize the chip in certain states, such as after a power-on reset condition.

SUMMARY OF THE INVENTION

It is therefore one object of the present invention to provide an improved computer chip having a multiplicity of on-chip capacitors used to enhance the power supply.

It is another object of the present invention to provide a method of testing such on-chip capacitors to determine their reliability and impact on operating conditions.

It is yet another object of the present invention to provide on-chip capacitors which may be entirely or selectively disabled.

The foregoing objects are achieved in a method of controlling a plurality of capacitors formed on a single substrate, generally comprising the steps of providing a plurality of transistors, each connected to a respective one of the capacitors, each of the transistors having a gate, and connecting each of the gates to a control circuit, the control circuit having means for selectively activating the gates to temporarily disable one or more of the capacitors. The control circuit can determine whether logic circuits which are connected to the capacitors are in a power-on reset mode, and disables all of the capacitors if the logic circuits are in the power-on reset mode. A plurality of fuses may be provided, each connected to a respective one of the capacitors, such that a given fuse can be blown to permanently disable a given one of the capacitors. The control circuit may include a multiplexer which receives inputs from the fuses and which further receives inputs from a register having a plurality of bits, such that a bit pattern may be loaded into the register, the bit pattern being used to determine which of the capacitors to selectively disable. The states of the fuses can further be loaded as a bit pattern into the register. Operating conditions of the logic circuits (such as temperature and performance) can be measured after disabling selected capacitors. Each capacitor can be sequentially disabled by sequentially activating a given one of the bits in the register.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein:

FIG. 4 is a chart illustrating the logic flow in testing on-chip capacitors according to the present invention.

DESCRIPTION OF THE PREFERRED EMBODIMENT

Figure 1:
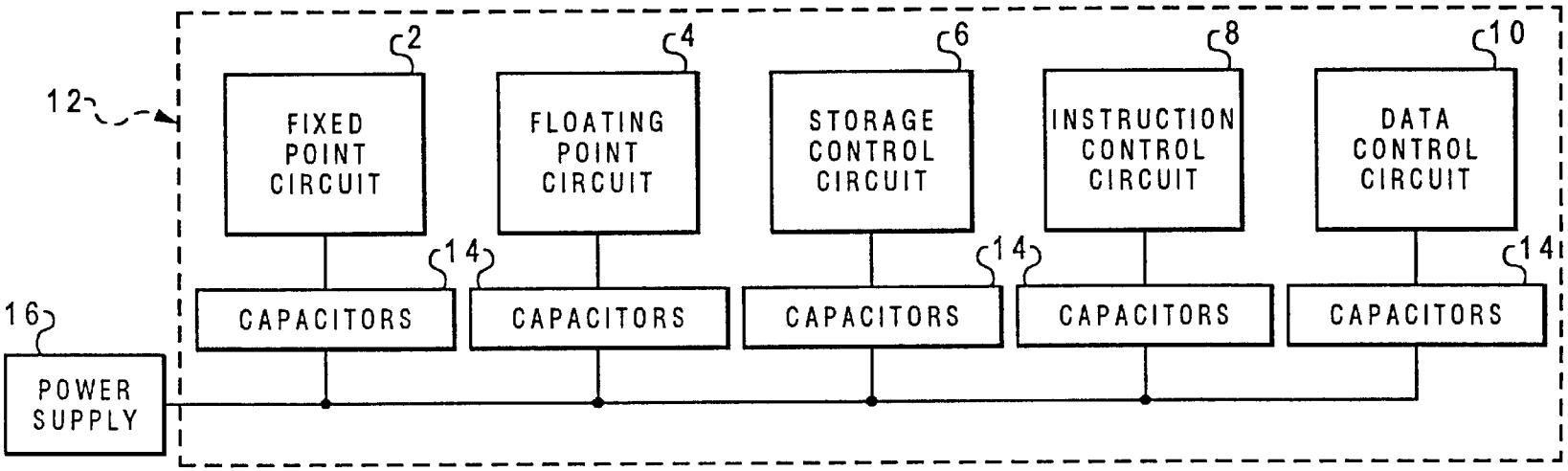
Fig. 1 Prior Art
FIG. 1 is a block diagram of a prior art computer chip having several circuit formed thereon, and several banks of capacitors which enhance the supply of power to the circuits.

The present invention is directed to a computer chip having a plurality of on-chip capacitors used to enhance the supply of power to various circuits fabricated on the chip, such as the on-chip capacitors shown in FIG. 1. While the present invention may be applied to a system such as that shown in FIG. 1, the computer system is not necessarily conventional, i.e., it could include new hardware components as well, or have a novel interconnection architecture for existing components. Therefore, while the present invention may be understood with reference to FIG. 1, this reference should not be construed in a limiting sense.

On-chip capacitor gating control requires special consideration since on-chip capacitors have only recently been implemented in chip designs, and there is a need to determine how the capacitors function and what their impact is on the chip's functionality. The present invention provides a method of analysis of this impact under different operating conditions and applications, including burn-in and system environment conditions, as well as functional and self-test applications.

Figure 2:
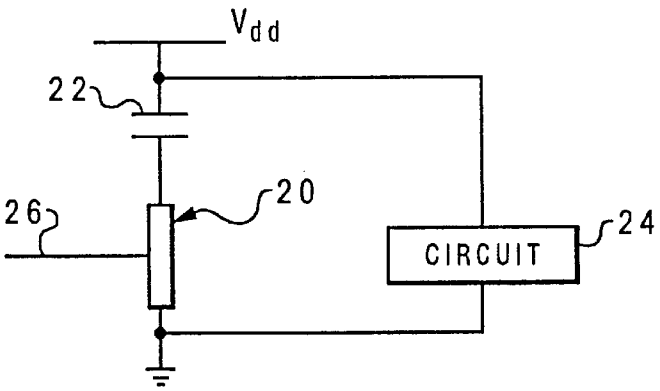
FIG. 2 is a schematic diagram illustrating degating of an on-chip capacitor according to the present invention.

As shown in FIG. 2, in one embodiment of the present invention a transistor 20 is used to disable an on-chip capacitor 22 which is coupled to the power supply $V_{dd}$ (e.g., 2.5 volts) in such a manner as to enhance supply of the power to an on-chip circuit 24. The path (or connection) from capacitor 22 to ground is made through transistor 20. Transistor 20 is preferably an NMOS field-effect transistor, although other transistors could be used. The gate 26 of NMOS transistor 20 is used to control the capacitor as discussed further below. All of the capacitors in each capacitor bank on the chip can be so controlled via separate lines connected to the gates of respective transistors.

Figure 3:
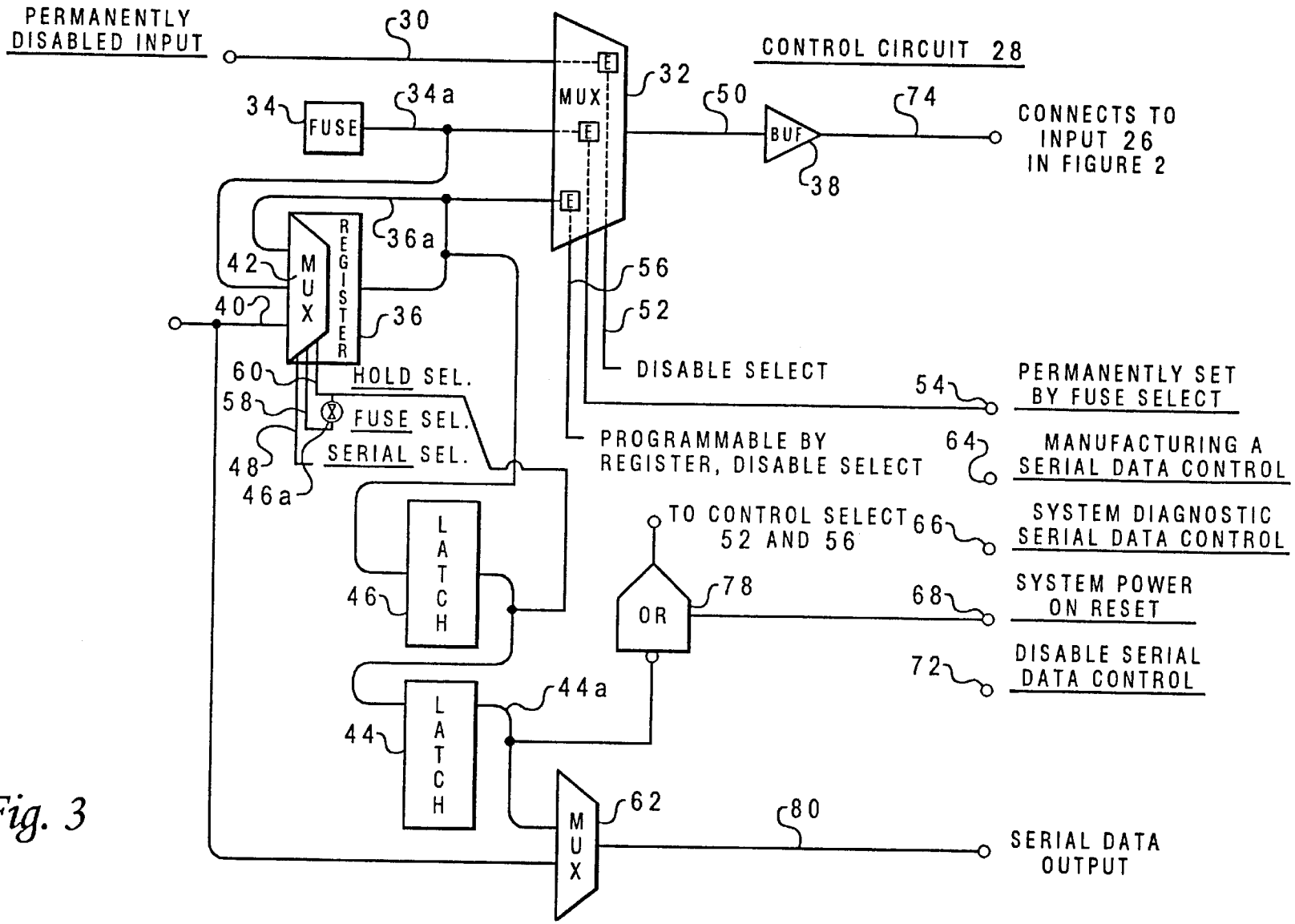
FIG. 3 is a schematic diagram depicting a circuit for selectively disabling one more banks of on-chip capacitors.

FIG. 3 depicts a control circuit 28 which can be used to control the disable input 18 to an on-chip capacitor 22 disable transistor 20.

The control circuit is essentially comprised of a three-input to one-output switch 32 referred to as a muxtiplexor, or MUX, and its output 50 controls the transistor 20 (shown in FIG. 2), typically wired through a repowering device 38 referred to as a buffer. MUX 32, along with buffer 38, is provided for each capacitor bank. Although only one is shown, it is understood that several may be provided, one per capacitor bank being controlled, e.g., if 32 banks of on-chip capacitors are provided, then 32 separate MUX components and buffer components are provided.

Three select inputs, namely the capacitor-disabled select 52, the permanently set, by fuse 34, select 54, and the programmable, by register 36, disable select 56, are the means to enable the three possible control mechanisms into multiplexor 32, which, respectively, are a fixed, permanently disabled input 30, a fuse input 34*a* from fuse 34, and a programmable register input 36*a* from programmable register 36. There is a unique, separate fuse 34 for each instance of MUX 32 that controls a unique and separate capacitor bank. Likewise, there is a unique, separate programmable register 36 for each instance of MUX 32 that controls a unique and separate capacitor bank.

In addition to the multiplexor 32, the control circuit 28 also depicts a second multiplexor 42 that provides the programmable register 36 with information for disabling the capacitors. Three select inputs, namely the serial data select 48, the fuse select input 58, and the hold select 60, are the means to enable into the register the corresponding programmable information 40, the permanently set, by fuse 34, information, or the retaining register information.

Further depicted in the control circuit 28 are five control circuit inputs, namely the manufacturing test serial data control input 64, the system diagnostic serial data control 66, the system power on reset control 68, the permanently set, by fuse 34, select 54, and the disable serial data control input 72.

Two additional programmable latches, namely the hold register value latch 46 and the selectable (programmable) control latch 44 are provided to create the select inputs to multiplexors 32 and 42.

The remaining component to list in control circuit 28 is the two-input to one-output multiplexor 62, which provides the mechanism for routing the serial data from the input to the programmable register, around the programmable register, to the serial data output of the control circuit 28, bypassing the programmable register 36 as well as the two programmable latches 46 and 44.

The primary control circuit output is the capacitor disable 74, which connects to the capacitor gate 20 control input 18. A secondary control circuit output 80, is the serial data from multiplexor 62, which connects the latch components of control circuit 28 into serial data shift register scan chains that are integral on the microprocessor circuits as in the prior art.

The steering of capacitor control information is derived from control circuit 28 inputs 64, 66, 68, 54, and 72, plus the programmable latches 44 and 46. The derived functions for the select inputs to multiplexors 32, 42, and 62 are based on boolcan logic. Beginning with multiplexor 32 select inputs, the fuse 34 input drives the multiplexor output 50 whenever the control circuit input 54, the permanently set, by fuse 34, select is asserted active. This assertion can be under mechanical or electrical means; for discussion purposes, it can simply be a relay or switch asserted by an experimenter. Consequently, for whenever input 54, the permanently set, by fuse 34, select is not being asserted, either the fixed, permanently disabled input 30 will be selected, or the programmable register input 36*a* will be selected. Control circuit 28 input for system power on reset 68 asserted, or the programmable latch 44 for "selectable control" 44*a* unasserted 78 will decide that permanently disabled input 30 to the multiplexor 32 drives the multiplexor output. Therefore, it follows that, whenever the permanently set, by fuse 34, select is not being asserted, and system power on reset 68 is not being asserted, and the selectable control latch 44 is being asserted, then the programmable register input 36*a* to multiplexor 32 drives the multiplexor 32 output 50.

Discussion follows in a manner similar to multiplexor 32 for the programmable register 36 input multiplexor 42. Whenever the control circuit input 64, the manufacturing test serial data control input, or control circuit input 68, the system power on reset control, are asserted, then the multiplexor 42 select enabling the serial data input 40 is asserted, and the programmable register receives its data from the serial data control circuit 28 input 40. The select enabling the serial data input 40 is also asserted whenever input 66 system diagnostic serial data control is asserted so long as the input 72, disable serial data, is not asserted. Given that the control inputs 64, 66, and 72 are not configured to enable the serial data input into multiplexor 42, then the programmable register input will be either the same programmable register content or the fuse 34 input, the deciding factor being whether the hold register value latch 46 is asserted or not, 46*a*. If the hold register value latch is asserted, then the programmable register input will be its own contents and thus maintain, or hold, its contents; otherwise, the value of fuse 34 will load into the programmable register.

Because the control circuit depicts the programming of the register 36 and the two MUX select control latches, 44 and 46, by means of serial data, otherwise known as a scan or shift mechanism, and because system diagnostic serial data shifting may be required while leaving unaffected the values set into register 36 and the two MUX select control latches, 44 and 46, the control circuit 28 input 72, disable serial data control, is required to be asserted after register 36, and the two MUX select control latches, 44 and 46, have been set by the system diagnostic serial data shifting. Further system diagnostic serial data shifting after input 72, disable serial data control, has been asserted and will route the serial data input 40 through the multiplexor 62 to secondary control circuit output 80, which would connect to the serial data input of another latch element in the system.

The foregoing scheme may further be understood with reference to the flowchart of FIG. 4. First, a determination is made of whether the permanently set, by fuse 34, input is asserted (82). If so, the capacitors are used according to which fuses have been preselected, i.e., according to whether or not a given fuse has been blown (84), and no further testing occurs. If the capacitors are not to be controlled by the fuse, then the next step (86) is to determine whether all of the capacitors are to be disabled, as would be the case if the power on reset input, 68, is asserted or the selectable control latch, 44, is not set. If capacitors are not to be controlled by the fuse 34, then all capacitor banks are disabled (88), and flow proceeds to the configuration complete check (120). If only a portion of the capacitor banks are to be disabled for testing, then the control circuit examines the states of the various control signals to determine if specially selected capacitor banks are to be tested based on the contents of register 36, or whether a preset condition of the capacitors (based on the states of the fuses) are to be used (90). If testing is to be performed using the preset conditions, then the fuse 34 input through MUX 42 is loaded (92) into register 36 and, again, flow proceeds to the configuration complete check. If preset conditions are not to be used, the control circuit next determines whether manufacturing test is to be performed (94), in which case, register 36 is set by the serial data (96). Moreover, in manufacturing test, one and only one of all the capacitor banks will be enabled while all others are disabled, and subsequently, the stand-by, or quiescent power supply current draw is measured (98). If excessive current is drawn (100), then fuse 34 for the corresponding capacitor bank is blown (102). If more capacitors are to be tested (104), then another register 36 is set up to enable one other, and only one other, capacitor bank (96).

If manufacturing test using register 36 is not desired, then the control circuit examines whether the system is in a power-on reset mode (110). If so, then each register 36 for each corresponding capacitor bank controlled is set to "disable" (112), and the circuit checks for the assertion of the system diagnostic serial shift input, 66.

When the system diagnostic serial shift is detected (114), the control circuit examines the states of the circuit input 72, the disable serial data shift control, to determine whether register 36 and the MUX select control latches 42 and 44 are to be set by shifting with serial data as well (116). Once the operator has loaded the pattern for selecting which capacitor banks will be enabled and which will be disabled (118), the configuration complete check is made (120). If the configuration is complete, then, based on the contents of the registers 36, the performance measurements, for instance, maximum processor-operating frequency, and operating conditions, such as temperature, are noted and recorded by the operator (122). If the operator chooses to continue analysis, the process proceeds to decision 114. When the system diagnostic serial shift is detected and the disable serial data shift control is not asserted (116), then a pattern may be loaded into the register (118) and, again, the configuration complete check is made (120).

After any measurements have been taken in step 122, the control circuit can further inquire as to whether any new patterns are to be used (124) in the testing of the capacitor banks. If so, flow control proceeds to decision 114 in order to check if the system diagnostic serial shift is being asserted.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that such modifications can be made without departing from the spirit or scope of the present invention as defined in the appended claims.

I claim:

1. A method of controlling a plurality of capacitors formed on a single substrate, comprising the steps of:

providing a plurality of transistors, each connected to a respective one of the capacitors, each of the transistors having a gate;

connecting each of the gates to a control circuit, the control circuit having means for selectively activating the gates to temporarily disconnect a conduction path of one or more of the capacitors; and providing a plurality of fuses, each connected to a respective one of the capacitors, such that a given fuse can be blown to permanently disconnect a given one of the capacitors.

2. The method of claim 1 wherein the capacitors are used to enhance power supply to a plurality of logic circuits formed on the substrate, and further comprising the steps of:

the control circuit determining whether the logic circuits are in a power-on reset mode; and the control circuit disconnecting all of the capacitors when the logic circuits are in the power-on reset mode.

3. The method of claim 1 wherein the control circuit includes a register having a plurality of bits, and further comprising the step of loading a bit pattern into the register, the bit pattern being used to determine which of the capacitors to selectively disconnect.

4. The method of claim 1 wherein the capacitors are used to enhance power supply to a plurality of logic circuits formed on the substrate, and further comprising the step of measuring operating conditions of the logic circuits after said disconnecting of one or more of the capacitors.

5. The method of claim 1 wherein the control circuit includes a multiplexer having a plurality of outputs respectively coupled to the transistor gates, the multiplexer receiving inputs from the fuses which have either an on or off state, and further comprising the step of examining a state of an additional input to the multiplexer to determine whether all of the capacitors are to be disconnected and, when all of the capacitors are to be disconnected, applying appropriate logic states to the multiplexer outputs to disconnect all the capacitors but, when less than all of the capacitors are to be disconnected, applying logic states to the multiplexer outputs based on the states of the fuses.

6. The method of claim 3 wherein each fuse has either an on or off state, and wherein the bit pattern that is loaded into the register is based on the states of the fuses.

7. The method of claim 3 wherein the control circuit includes a multiplexer having a plurality of outputs respectively coupled to the transistor gates, the multiplexer receiving inputs from the register, and further comprising the step of examining a state of an additional input to the multiplexer to determine whether all of the capacitors are to be disconnected and, when all of the capacitors are to be disconnected, applying appropriate logic states to the multiplexer outputs to disconnect all the capacitors but, when less than all of the capacitors are to be disconnected, applying logic states to the multiplexer outputs based on contents of the register.

8. The method of claim 6 wherein the capacitors are used to enhance power supply to a plurality of logic circuits formed on the substrate, and the control circuit includes a multiplexer having a plurality of outputs respectively coupled to the transistor gates, the multiplexer receiving inputs from the register and the fuses, and further comprising the steps of:

examining a state of an additional input to the multiplexer to determine whether all capacitors are to be disconnected;

when the additional input indicates that capacitors are not to be disconnected, then applying logic states to the multiplexer outputs based on the states of the fuses; and when the additional input indicates that capacitors are to be disconnected, determining whether the logic circuits are in a power-on reset mode and, when the logic circuits are in the power-on reset mode, then applying appropriate logic states to the multiplexer outputs to disconnect all the capacitors but, when the logic circuits are not in the power-on reset mode, applying logic states to the multiplexer outputs based on contents of the register.

9. A circuit for controlling a plurality of capacitors formed on a single substrate, the capacitors being connected to respective transistors, each transistor having a gate, the circuit comprising:

a plurality of fuses each having an on or off state, respectively connected to the capacitors such that a given fuse can be blown to permanently disconnect a given one of the capacitors; and a multiplexer having a plurality of outputs respectively coupled to the transistor gates, said multiplexer receiving inputs from said fuses, and having an additional input, said multiplexer applying appropriate logic states to said multiplexer outputs to disconnect all the capacitors when said additional input is in a first state, and applying logic states to said multiplexer outputs based on said states of said fuses when said additional input is in a second state.

10. The circuit of claim 9 wherein the capacitors are used to enhance power supply to a plurality of logic circuits formed on the substrate, and further comprising means for determining whether the logic circuits are in a power-on reset mode, said multiplexer applying said appropriate logic states to said multiplexer outputs to disconnect all the capacitors only when the logic circuits are in the power-on reset mode.

11. The circuit of claim 9 further comprising a register having a plurality of bits for receiving a bit pattern, said register connected as an input to said multiplexer, wherein said multiplexer further applies logic states to said multiplexer outputs based on said bit pattern to selectively disconnect one or more of the capacitors.

12. The circuit of claim 11 further comprising means for loading a bit pattern into said register based on said states of said fuses.

13. A circuit for controlling a plurality of capacitors formed on a single substrate, the capacitors being connected to respective transistors, each transistor having a gate, the circuit comprising:

a register having a plurality of bits for receiving a bit pattern; and means for selectively disconnecting one or more of the capacitors based on said bit pattern.

14. The circuit of claim 13 wherein said disconnecting means includes a multiplexer having a plurality of outputs respectively coupled to the transistor gates, and further comprising a plurality of fuses each having an on or off state, respectively connected to the capacitors such that a given fuse can be blown to permanently disconnect a given one of the capacitors, said multiplexer receiving inputs from said fuses, and including means for applying logic states to said multiplexer outputs based on said states of said fuses.

15. The circuit of claim 14 wherein the capacitors are used to enhance power supply to a plurality of logic circuits formed on the substrate, and further comprising means for determining whether the logic circuits are in a power-on reset mode, said multiplexer applying appropriate logic states to said multiplexer outputs to disconnect all the capacitors when the logic circuits are in the power-on reset mode.

* * * * *